United States Patent [19]

Bara Marco

[11] 4,126,022

[45] Nov. 21, 1978

[54] LOCK CONSTRUCTION FOR GLASS DOORS

[76] Inventor: Luis Bara Marco, 32 Progresso St., Barcelona, Spain

[21] Appl. No.: 800,849

[22] Filed: May 26, 1977

[30] Foreign Application Priority Data

May 29, 1976 [ES] Spain ..... 211.314

[51] Int. Cl.[2] ..... E05B 9/08

[52] U.S. Cl. ..... 70/102; 70/134; 70/451; 292/288; 292/DIG. 28; 292/DIG. 53

[58] Field of Search ..... 70/102, 103, 104, 105, 70/106, 97, 95, 100, 129, 130, 131, 132, 133, 134, 451; 292/258, 288, DIG. 28, DIG. 53

[56] References Cited

U.S. PATENT DOCUMENTS

| | | | |
|---|---|---|---|
| 1,325,919 | 12/1919 | Voight | 70/106 |
| 1,426,930 | 8/1922 | Waldron | 292/DIG. 28 X |
| 1,428,915 | 9/1922 | Seweryn | 70/136 X |
| 1,744,988 | 1/1930 | Shaw | 70/103 X |
| 2,050,696 | 8/1936 | Schoorel | 70/95 |
| 2,874,560 | 2/1959 | Villalba | 70/134 |
| 2,936,139 | 5/1960 | Lindstrom | 248/206 R X |
| 3,367,700 | 2/1968 | Carmcero | 292/288 |
| 3,774,420 | 11/1973 | Orr | 70/104 |

*Primary Examiner*—Thomas J. Holko

*Attorney, Agent, or Firm*—Larson, Taylor and Hinds

[57] ABSTRACT

An improved lock is provided for hinged glass doors which can be attached to the doors without the need for attachment screws and the like. The lock includes a pair of coacting casings which include suction-type securing means for attaching the casings to the respective doors. The first casing comprises a single piece integral metal housing which is open on one side and includes a locking mechanism, having an associated lock bolt, which is disposed in and occupies approximately one-half of the housing, the other half being empty. The second casing member comprises a base portion which is similar to the first housing and includes, in addition, an "upper" or overlying portion which extends parallel to the base portion and is affixed thereto by an upstanding wall located in approximately the middle of the base portion. In the operative position of the lock, the empty half of the first casing overlies the upper portion of the second casing and the lock bolt extends through the upstanding wall of the second casing to provide locking.

9 Claims, 13 Drawing Figures

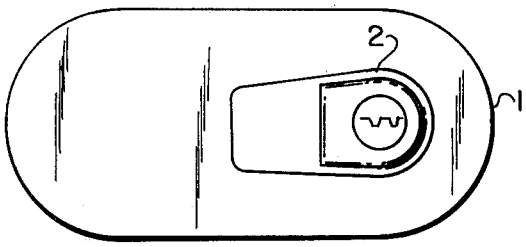
FIG. 1A
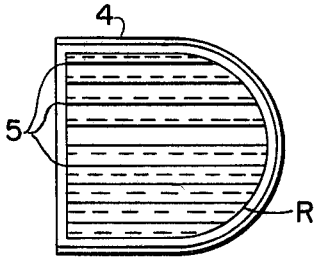
FIG. 1D
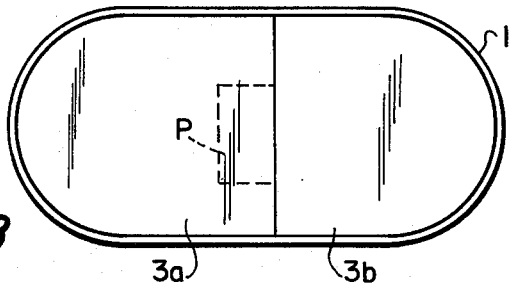
FIG. 1B
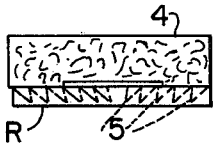
FIG. 1E
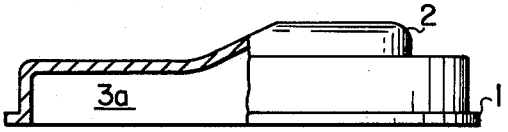
FIG. 1C
FIG. 2A
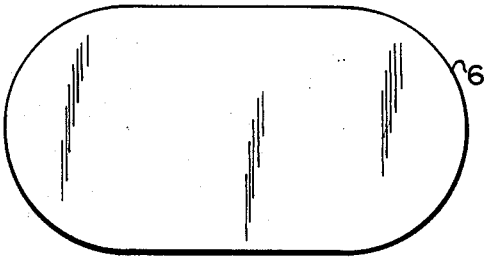
FIG. 2D
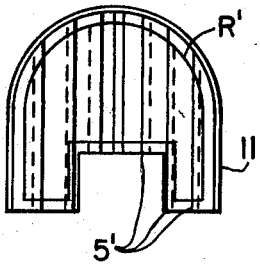
FIG. 2F
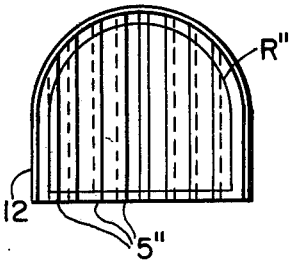
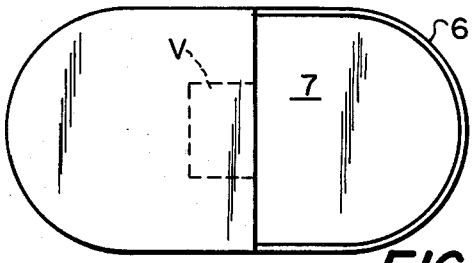
FIG. 2B
FIG. 2G
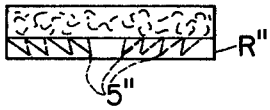
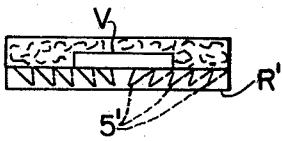
FIG. 2E
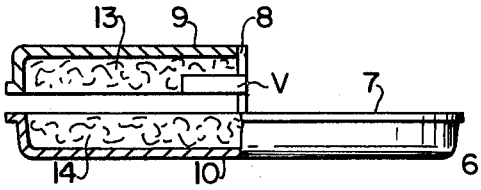
FIG. 2C

LOCK CONSTRUCTION FOR GLASS DOORS

FIELD OF THE INVENTION

The present invention relates to locks for doors and, more particularly, to an improved construction lock for hinged glass doors which can be attached thereto without the need for attachment screws or the like.

BACKGROUND AND SUMMARY OF THE INVENTION

The invention concerns a lock construction which is particularly adapted for use with hinged glass doors wherein, for example, the mating edges of the doors are brought together to provide closing. Among other advantages, the lock construction of the invention that eliminates the need for employing attachment screws or like securing elements which require that holes be made in the door glass. Moreover, although the attachment provided is extremely sound, with the lock construction being solidly adhered to the door glass, the nature of attachment permits easy use of the lock construction and the installation of the lock construction at any height.

According to a preferred embodiment thereof, the lock construction of the invention comprises first and second coacting casings. The first casing comprises a single piece integral housing member which is open on one side thereof and includes a standard locking mechanism, including a lock bolt, disposed in, and occupying approximately one-half of, the lock casing. The other half of the casing is empty and the lock bolt extends into the empty half in the latching state of the locking mechanism. The first casing is adapted to be secured to the door glass by securing means in the form of a pad including engagement fins that provide a suction effect. The second casing includes a base member which is similar to the housing member of the first casing and an "upper" or overlying member which extends parallel to and is spaced from the base member. The upper member overlies approximately one-half of the base member and is affixed thereto by an upstanding wall extending at 90° from the upper member and disposed in the middle of the base member. Gaskets, including engagement fins such as discussed above, are located in recesses in both the upper and base members. With the lock in the operative position, the "empty" portion of the housing member of the first casing fits over the "upper" member of the second casing and the lock bolt extends through an aperture in the wall of the second casing to provide latching or locking.

Other features and advantages of the invention will be set forth in, or apparent from, the detailed description of the preferred embodiments found hereinbelow.

BRIEF DESCRIPTION OF THE DRAWINGS

FIG. 1A is a top plan view of a preferred embodiment of the first of a pair of casings which co-act to form the lock of the invention;

FIG. 1B is a bottom plan view of the casing of FIG. 1A;

FIG. 1C is a side elevational view, partially in section, of the casing of FIG. 1A;

FIG. 1D is a bottom plan view of a pad which is attached to the casing of FIGS. 1A to 1C;

FIG. 1E is an end elevational view of the pad of FIG. 1D;

FIG. 2A is a bottom plan view of a preferred embodiment of a second casing which co-acts with that of FIG. 1A;

FIG. 2B is a top plan view of the casing of FIG. 2A;

FIG. 2C is a side elevational view, partially in section, of the casing of FIG. 2A;

FIGS. 2D and 2E are respectively bottom plan and end elevational views of a first gasket incorporated in the casing of FIGS. 2A to 2C;

FIGS. 2F and 2G are respectively bottom plan and end elevational views of a second gasket incorporated in the casing of FIGS. 2A to 2C.

DESCRIPTION OF THE PREFERRED EMBODIMENTS

Figure 3:
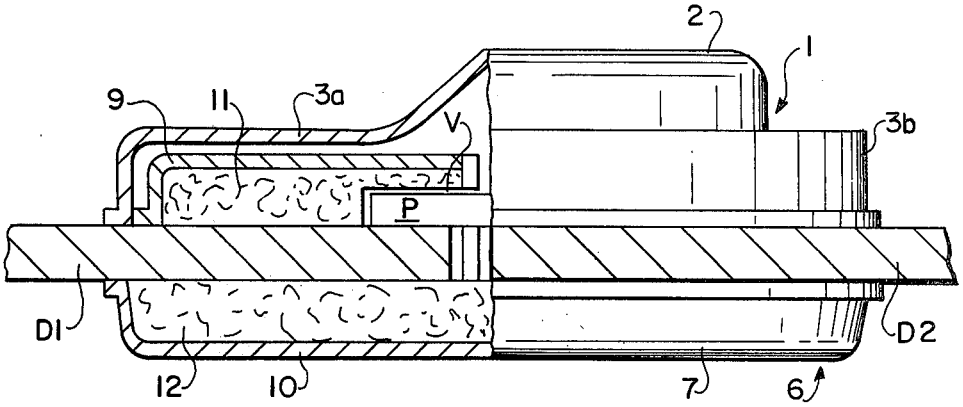
FIG. 3 is a side elevation, partially in section, of the assembled lock.

The lock construction of the present invention comprises first and second co-acting housings or casings denoted 1 and 6, casing 1 being illustrated in FIGS. 1A to 1E and casing 6 being illustrated in FIGS. 2A to 2G.

Casing 1 is preferably of the elongate generally cup-shaped form illustrated and is advantageously fabricated of metal which is die stamped to produce the desired shape. As shown in FIG. 1B, which illustrates the underside of casing 1, casing 1 includes a first portion **3*a* which is open on one side (see also FIG. 1C) and is adapted to receive a reciprocially shaped portion of housing 6 as described hereinbelow, and a second portion 3*b* which occupies approximately one-half of the casing 1 and which houses the locking mechanism (not shown) for the lock. The locking mechanism can be of any one of a number of standard types and the locking bolt P of the mechanism when actuated, projects into the open portion 3*a* of the casing 1**.

The "upper" side of housing 3 includes a raised portion 2 (see FIGS. 1A and 1C) which is integral with the remainder of the casing and which constitutes a keyhole for the locking mechanism.

A pad 4 of rubber or a suitable similar material is illustrated in FIGS. 1D and 1E and includes a plurality of flexible longitudinally extending fins or gripping teeth 5. As illustrated, one half of the fins 5 are disposed on one side of the centerline of the housing and the other half are disposed on the other side symmetrically to the first half, with both sets of the fins 5 being inclined toward the opposite side (i.e., the center). Pad 4 is adapted to be attached to the underside of portion **3*b* of the casing 1 and forms a suction or vacuum cup when pressed into engagement with one of the glass doors to be locked, as is described hereinbelow in connection with FIG. 3**. It will be appreciated that a sealing rib or the like (not shown) should be provided around the edge of fins to provide sealing.

This sealing rib is denoted R in FIGS. 1D and 1E, R′ in FIGS. 2D and 2E, and R″ in FIGS. 2F and 2G.

Casing 6 is similar to casing 1, as illustrated, but includes a vertical wall or plate 8 in the approximately middle thereof which supports an "upper" portion 9 that extends generally parallel to the plane of casing 6. Portion 9 includes a peripheral apron which forms a recess 13. Casing 6 also includes a lower portion 10 which is disposed beneath upper portion 9 as viewed in FIG. 2 and which also includes a peripheral apron that defines a recess 14 which opens toward recess 13. Portion 10 is contiguous with a further portion 7 that forms a similar recess (see FIGS. 2B and 2C). Plate 8 includes an aperture V therein through which bolt P extends in the actuated state thereof.

Recesses 13 and 14 are adapted to respectively receive gaskets 11 and 12 which are similar to pad 4 described above. The gasket 11 is illustrated in FIGS. 2D and 2E and, as shown, includes a plurality of engagement fins 5'. Similarly, gasket 12, which is illustrated in FIGS. 2F and 2G, includes a plurality of engagement fins 5''. Fins 5' and 5'' are disposed as illustrated, and as described above in connection with fins 5. Gaskets 11 and 12 also serve as suction or vacuum cups so that when housing 6 is attached to the edge of other glass door, it is firmly secured thereto without slipping or sliding and without the need for attachment screws. As illustrated, the upper gasket 11 includes an aperture therein which is a continuation of aperture V in plate 8.

Referring to FIG. 3, the lock of the invention is shown in the assembled state thereof. Casing 6 is attached to an edge of a first door D1 with the door edge being received between portions 9 and 10 and held in engagement by fins 5' and 5'' of gaskets 11 and 12. Casing 1 is attached to an edge of a second door D2 at the same height as casing 6, fins 5 of pad 4 (which cannot be seen in FIG. 3) serving to attach housing 1 to door D2 by means of suction. Casings 1 and 6 are aligned so that bolt P will enter into opening V of casing 6 and thereby provide locking of the doors. On the other hand, with bolt P retracted, the doors can be freely opened.

Although the invention has been described relative to an exemplary embodiment thereof, it will be understood that other variations and modifications can be effected in this embodiment without departing from the scope and spirit of the invention.

I claim:

1. An improved lock for a pair of hinged glass doors or the like, said lock comprising first and second coacting casings, said first casing comprising a single piece integral metal housing member open on one side and including a locking mechanism, including a lock bolt, disposed in and occupying approximately one-half of said first casing, the other half of the first casing being empty and said lock bolt extending toward said empty half of said first casing in the latching position thereof, the open side of said first casing engaging the pair of doors on one side thereof, said second casing comprising a base member engaging the pair of doors on the other side thereof and further including means connected to said base member for engaging one of the doors on the said one side thereof, said engaging means being received in said empty half of said first casing.

2. A lock as claimed in claim 1 wherein said housing member includes a raised portion on an outer surface thereof which constitutes the key hole for the locking mechanism and is integral with the remainder of the housing member.

3. A lock as claimed in claim 2 wherein the portion of the half of the first casing corresponding to the area occupied by said locking mechanism has attached thereto means for securing the first casing to the edge of one of the glass doors, said securing means being constructed of a resilient material and including, on the outer face thereof, a plurality of engagement fins, one half of said fins being disposed on one side of said housing member and being obliquely inclined in a first direction toward the center of said housing member and the other half of said fins being disposed on the other side of said housing member and being obliquely inclined in the opposite direction, said fins being arranged symmetrically on said housing member and said securing means acting as a suction cup when the said first casing is secured to the door glass.

4. A lock as claimed in claim 2 wherein said base member is open on one of the sides thereof and includes an upstanding wall located in approximately the middle thereof, said wall supporting, and forming a 90° angle with, said engaging means, said wall being disposed between the edges of the doors in the locking position of the lock, said engaging means comprising a planar member which extends parallel to the general plane of the base member and which functions to secure said second casing to said one side of the said one door, said planar member including a peripheral apron forming a recess, said base member forming a further recess which faces the recess formed by the peripheral apron of said planar member so that the said one door is disposed between said recesses in the locking position of the lock.

5. A lock as claimed in claim 4 further comprising gaskets of a resilient material disposed in said recesses and including fins on a door facing surface thereof, for providing a suction connection between the door glass and the second casing.

6. A lock as claimed in claim 1 wherein the portion of the half of the first casing corresponding to the area occupied by said locking mechanism has attached thereto means for securing the first casing to an edge of one of the glass doors, said securing means being constructed of a resilient material and including, on the outer face thereof, a plurality of engagement fins, one half of said fins being obliquely inclined in a first direction towards the center of the housing member and the other half of said fins being obliquely inclined in the opposite direction towards the center of the housing member, said fins being arranged symmetrically on said housing member and said securing means acting as a suction cup when the said first casing is secured to the door glass.

7. A locking as claimed in claim 6 wherein said base member is open on one of the sides thereof and includes an upstanding wall located in approximately the middle thereof, said wall supporting, and forming a 90° angle with, said engaging means, said wall being disposed between the edges of the doors in the locking position of the lock, said engaging means comprising a generally planar member which extends parallel to the plane of the base member and which functions to secure said second casing to said one side of the one door, said planar member including a peripheral apron forming a recess which opens toward the surface of the one door, said base member forming a further recess which faces the recess formed by the peripheral apron of said planar member so that said one door is disposed between said recesses in the locking position of the lock.

8. A lock as claimed in claim 1 wherein said base member is open on one of the sides thereof and includes an upstanding wall located in approximately the middle thereof, said wall supporting, and forming a 90° angle with said engaging means, said wall being disposed between the edges of the doors in the locking position of the lock, said engaging means comprising a generally planar member which is spaced from and extends parallel to the plane of the base member and which functions to secure said second casing to said one side of said one of the doors, said planar member including a peripheral apron forming a recess which opens towards one surface of the one door, said base member forming a further recess which faces said recess formed by the peripheral apron of said planar member so that said one door is disposed between said recesses in the locking position of the lock.

9. A lock as claimed in claim 8 further comprising gaskets of a resilient material disposed in said recesses and including fins on a door facing surface thereof, for providing a suction connection between the door glass and the second casing.

* * * * *